US005359737A

United States Patent [19]

Hodge

[11] Patent Number: 5,359,737

[45] Date of Patent: Nov. 1, 1994

[54] CONVERTIBLE MULTI-FUNCTIONAL SEAT APPARATUS

[76] Inventor: Trevorlyn H. Hodge, 62 Winfield Ave., Mt. Vernon, N.Y. 10552

[21] Appl. No.: 18,742

[22] Filed: Feb. 17, 1993

[51] Int. Cl.[5] ..... A47K 11/04

[52] U.S. Cl. ..... 4/483; 4/484; 4/478; 4/476

[58] Field of Search ..... 4/484, 476, 477, 478, 4/449, 452, 483, 236; 297/192, 153, 129, 188, 194, DIG. 2, 250.1, 440.21, 440.16, 256.15, 452.21, 452.16, 353, 440.16, 452.11; 224/155, 153

[56] References Cited

U.S. PATENT DOCUMENTS

| | | | |
|---|---|---|---|
| 1,910,736 | 5/1933 | Arthur | 4/484 |
| 2,320,845 | 6/1943 | Bolton | 4/452 |
| 2,459,601 | 1/1949 | Tiritilli et al. | 4/484 |
| 2,711,207 | 6/1955 | Roth | 4/484 |
| 3,127,215 | 3/1964 | Hubbard | 297/118 |
| 3,213,467 | 10/1965 | Hubbard | 4/478 |
| 3,258,291 | 6/1966 | Ezquerra | 297/217 |
| 3,490,808 | 1/1970 | Siegel | 297/153 |
| 3,590,401 | 7/1971 | Brown | 4/236 |
| 3,841,704 | 10/1974 | Platner et al. | 297/DIG. 2 |
| 4,296,506 | 10/1981 | Stoute, Sr. et al. | 4/452 |
| 4,417,764 | 11/1983 | Marcus et al. | 297/194 |
| 4,759,086 | 7/1988 | Booth-Cox | 4/452 |
| 4,777,672 | 10/1988 | Gebhard et al. | 4/449 |
| 4,785,483 | 11/1988 | Wise | 4/321 |
| 4,871,209 | 10/1989 | Handelman | 297/DIG. 2 |
| 5,169,211 | 12/1992 | Inaba et al. | 297/440.16 |

FOREIGN PATENT DOCUMENTS

| | | | |
|---|---|---|---|
| 469478 | 11/1950 | Canada | 4/483 |

*Primary Examiner*—Henry J. Recla
*Assistant Examiner*—Gregory M. Vidovich
*Attorney, Agent, or Firm*—John R. Flanagan

[57] ABSTRACT

A convertible multi-functional seat apparatus includes a base having a generally horizontal seat with an opening formed therein and a pair of generally vertical armrests disposed along and extending above opposite sides of the seat, and a generally upright back attached to the base and disposed along a rear end of the seat. The seat apparatus also includes a seat potty cover supported on the seat for movement between a first position adjacent to seat in which the cover overlies and conceals the opening and a second position remote from the seat in which the cover is displaced from and exposes the opening. The potty assembly is disposed in the opening and supported by an internal rim of the seat forming the opening therein. The potty assembly includes a replaceable plastic bag and an annular retainer ring supporting the bag about a peripheral edge portion thereof in the opening by the internal rim of the seat.

17 Claims, 3 Drawing Sheets

CONVERTIBLE MULTI-FUNCTIONAL SEAT APPARATUS

BACKGROUND OF THE INVENTION

Field of the Invention

The present invention generally relates to vehicle passenger seats and, more particularly, is concerned with a convertible multi-functional seat apparatus.

Description of the Prior Art

Vehicles are supplied with toilets to enable its passengers to travel long distances without leaving the vehicle, to avoid having to use public restrooms, to provide accessible private toilet facilities for handicapped travellers, and to provide toilet facilities in remote geographical areas. Vehicles have limited interior space and interior toilets must be space efficient. Further, modern travel conditions require that any mobile toilet retain waste for disposal at an appropriate site.

One recent approach to provision of suitable toilet facilities in a vehicle is disclosed in U.S. Pat. No. 4,785,483 to Wise. The approach of this patent is to provide an apparatus which integrates a toilet system with the structure of a vehicle passenger seat. While the toilet, due to integration with the seat, requires no space in the vehicle beyond that occupied by the seat, the integrated seat and toilet apparatus of the cited patent requires a water supply and a waste collection system which require additional space in the vehicle and add significant cost to the provision of toilet facilities. Thus, the need for a water supply and waste collection system constitutes a significant drawback of the integrated seat and toilet apparatus of the cited patent.

Consequently, whereas the integrated seat and toilet approach of the cited patent constitutes a step in the right direction, a need still exists for an improvement of this approach so as to overcome the drawbacks associated therewith.

SUMMARY OF THE INVENTION

The present invention provides a convertible multi-functional seat apparatus designed to satisfy the aforementioned need. The multi-functional seat apparatus of the present invention overcomes the drawbacks of the integrated seat and toilet apparatus of the above-cited patent by eliminating the need for a water supply and a waste collection system located beyond the boundary of the toilet. Also, the seat apparatus of the present invention incorporates other useful and desirable functions besides the provision of a toilet therein.

Accordingly, the present invention is directed to a convertible multi-functional seat apparatus which comprises:

(a) a base having a generally horizontal seat and a pair of generally vertical armrests disposed along and extending above opposite sides of the seat, the seat having means defining an opening therein;

(b) a generally upright seat back attached to the base and disposed along a rear end of the seat;

(c) a seat potty cover supported on the seat for movement between a first position adjacent to the seat in which the cover overlies and conceals the opening and a second position remote from the seat in which the cover is displaced from and exposes the opening; and (d) a potty assembly disposed in the opening and supported by an opening defining means of the seat, the potty assembly including a replaceable receptacle and an annular retainer ring supporting the receptacle about a peripheral edge portion thereof and being releasably supported in the opening by the opening defining means of the seat.

More particularly, the receptacle is a replaceable flexible plastic liner bag fabricated of a material impervious to fluids. The retainer member is an annular ring. The plastic liner bag has an upper peripheral edge portion defining an open top on the bag. The peripheral edge portion is foldable over the annular ring such that the bag edge portion surrounds the annular ring and is anchored between the ring and an internal annular rim of the seat defining the opening. The annular ring includes a pair of end portions telescopically interfitted together for adjusting the cirumferential size of the ring to snugly fit within the opening in the seat.

Further, the base has a rigid interior shell and an exterior covering. The seat back has a rigid internal shell and an external covering. The seat apparatus has a pair of attachment members and pairs of vertically-aligned attachment slots. The attachment members are mounted on a seat portion of the interior shell of the base in spaced relation to one another and extending upright along a rear edge portion thereof. The pairs of vertically-aligned attachment slots are provided in the internal shell of the seat back to removably receive the attachment members on the interior shell of the base so as to dispose the internal shell of the seat back in the generally upright position along the rear end of the seat of the base. Also, a pair of latch assemblies are respectively mounted to rearward ends of a pair of armrest portions of the interior shell of the base. The latch assemblies are releasably engageable with the attachment members for releasably attaching the seat back to the base.

Also, the seat apparatus includes a removable child restraint bar and a pair of lock assemblies. The restraint bar is releasably mounted at opposite ends thereof to the pair of armrest portions of the interior shell of the base. The lock assemblies are respectively mounted to forward ends of the pair of armrest portions of the interior shell of said base. The lock assemblies are releasably engageable with the opposite ends of the restraint bar for releasably locking the restraint bar to the armrest portions of the interior shell of the base such that the restraint bar extends over and is spaced above the seat portion of the interior shell of the base.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 3 is an enlarged fragmentary vertical sectional view of the seat base of the apparatus with the potty assembly installed in the opening therein.

DETAILED DESCRIPTION OF THE INVENTION

Figure 1:
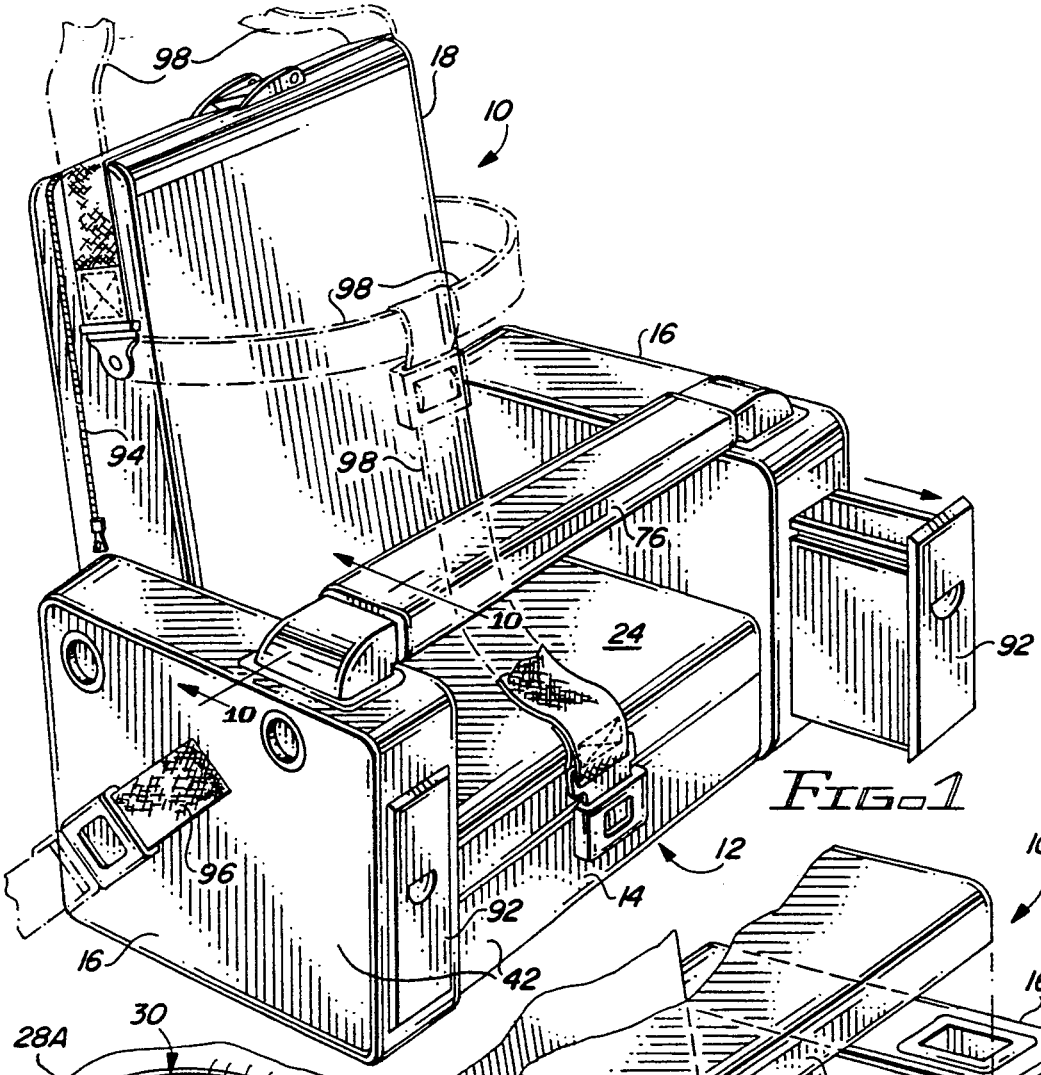
FIG. 1 is a perspective view of a convertible multi-functional seat apparatus of the present invention in assembled form.

Referring to the drawings and particularly to FIGS. 1 to 6, there is illustrated a convertible multi-functional seat apparatus, generally designated 10, of the present invention. Basically, the seat apparatus 10 includes a base 12 having a generally horizontal seat surface and having a generally horizontal seat 14 and a pair of generally vertical armrests 16 disposed along and extending above opposite sides of the seat 14. The seat apparatus 10 also basically includes a generally upright seat back 18 attached to the base 12 and disposed along a rear end of the seat 14. The seat 14 has an opening 20 formed therein by an internal annular rim 22.

The seat apparatus 10 further basically includes a seat potty cover 24 and a potty assembly 26. The potty cover 24 can be a padded cushion supported on the seat 14 and movable between first and second positions, as shown respectively in FIGS. 1 and 2. In the first position of FIG. 1, the cover 24 is located between the armrests 16 and adjacent to the seat 14 overlying and concealing the opening 20. In the second position of FIG. 2, the cover 24 is displaced remote from the seat 14 exposing the opening 20. Alternatively, the potty cover 24 can be a padded lid pivotally mounted at a rear end to the seat 14 rearwardly of the opening 20 for movement between the aforementioned first and second positions.

Referring to FIGS. 2 to 5, there is illustrated the potty assembly 26 disposed in the opening 20 in the seat 14 and supported by the internal annular rim 22 on the seat 14 which forms the opening 20 therein. The potty assembly 26 basically includes a replaceable flexible receptacle 28 and an annular retainer ring 30 supporting the flexible receptacle 28 about a peripheral edge portion 28A thereof. The annular retainer ring 30, in turn, is releasably supported in the opening 20 of the seat 14 by the internal annular rim 22 of the seat 14. The seat 14 also can have a rigid bowl-shaped receptacle 32 integrally attached to and supported by the internal annular rim 22 so as to underlie and support a bottom portion 28B of the flexible receptacle 28. Alternatively, the rigid receptacle 32 can omitted.

Figure 4:
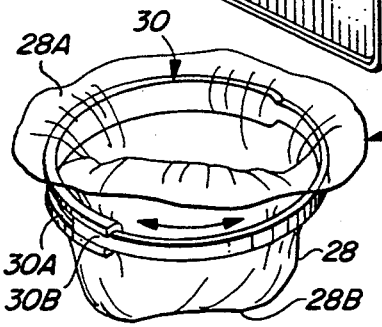
FIG. 4 is a perspective view of an adjustable annular retainer ring and a disposable plastic liner bag of the potty assembly.
Figure 5:
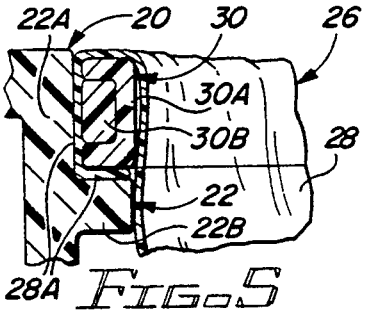
FIG. 5 is an enlarged sectional view of the adjustable annular retainer ring and disposable plastic liner bag of the potty assembly.

More particularly, as best seen in FIGS. 3 to 5, the flexible receptacle 28 is preferably a replaceable biodegradeable flexible plastic liner bag 28 fabricated of a material impervious to fluids. The plastic liner bag 28 has an upper peripheral edge portion 28A defining an open top on the bag. The peripheral edge portion 28A of the bag 28 is foldable over the annular ring 30 such that the bag edge portion 28A surrounds the annular ring 30 and is anchored between the ring 30 and the vertical and horizontal portions 22A, 22B of the internal rim 22 of the seat. The annular ring 30 is fabricated of a semi-rigid semi-flexible material, such as a suitable plastic material, and includes a pair of end portions 30A, 30B which are telescopically interfitted together, as seen in FIG. 4, for adjusting the cirumferential size of the ring 30 to snugly fit within the opening 20 and upon the annular rim 22 of the seat 14. A cup-shaped urine deflector 34 is provided for removably mounting to the seat 14. The deflector 34 has a pair of legs 36 thereon which snugly fit into apertures 38 formed in the seat 14 adjacent to a front side of the opening 20 in the seat 14.

Figure 2:
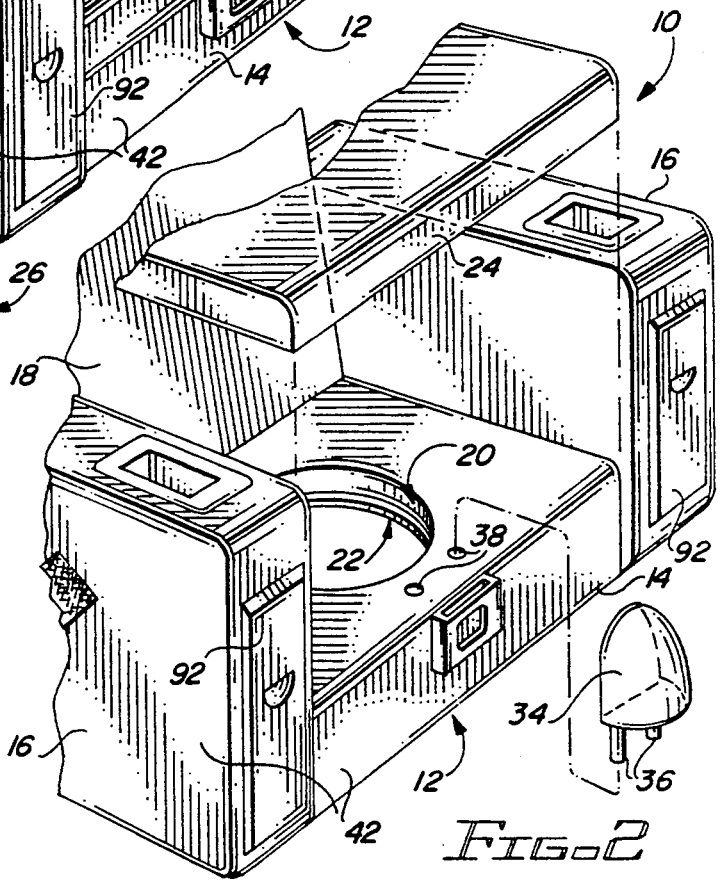
FIG. 2 is a fragmentary perspective view of the seat apparatus illustrating a seat potty cover of the apparatus lifted exposing an opening formed in a seat base for accommodating a potty assembly.

Referring to FIGS. 1, 2, 6 and 13, the base 12 formed by a rigid interior structural framework or shell 40 and an exterior flexible padded covering 42 which is shown enclosing the base shell 40 in FIGS. 1 and 2. Similarly, the seat back 18 is formed by a rigid internal structural framework or shell 44 and an external flexible padded covering 46 which is shown enclosing the seat back shell 44 in FIG. 13. The base interior shell 40 has a seat portion 48 and a pair of armrest portions 50 rigidly connected to, disposed along and extending above opposite sides of the seat portion 8. The seat portion 48 includes the internal annular rim 22 which defines the seat opening 20 and supports the potty assembly 26.

Figure 6:
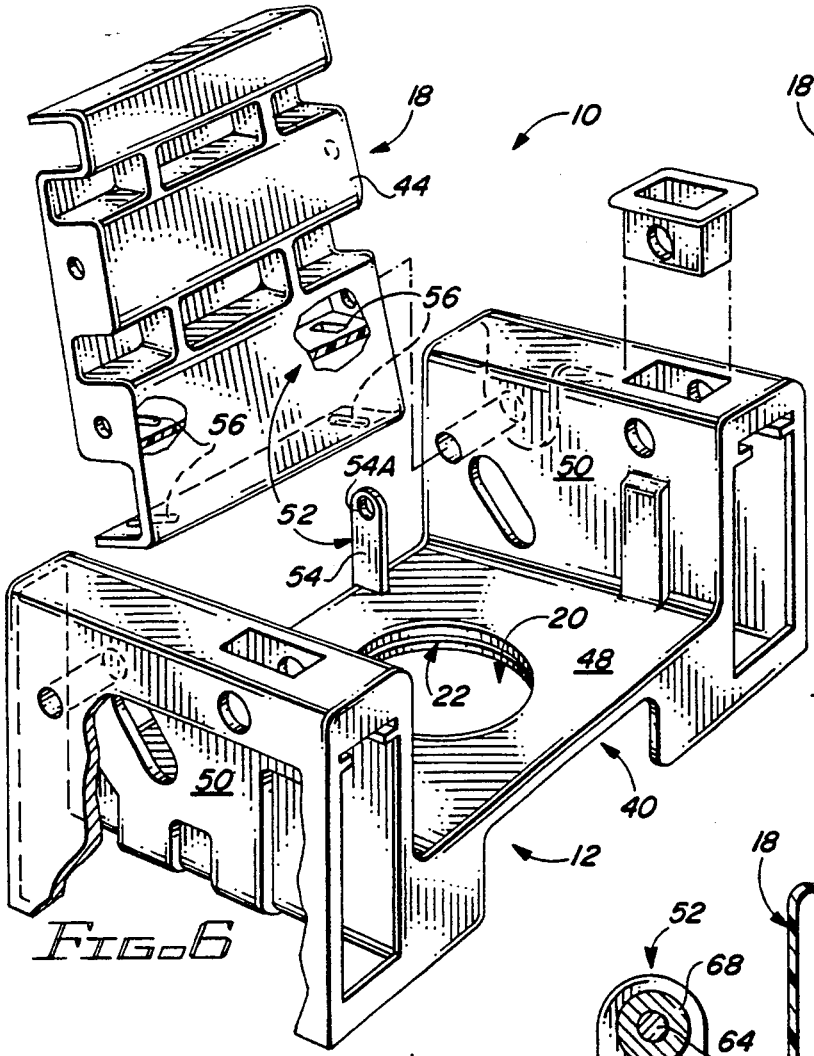
FIG. 6 is an exploded perspective view of a rigid structural shell of the seat apparatus of FIG. 1 having seat back and base portions.
Figure 7:
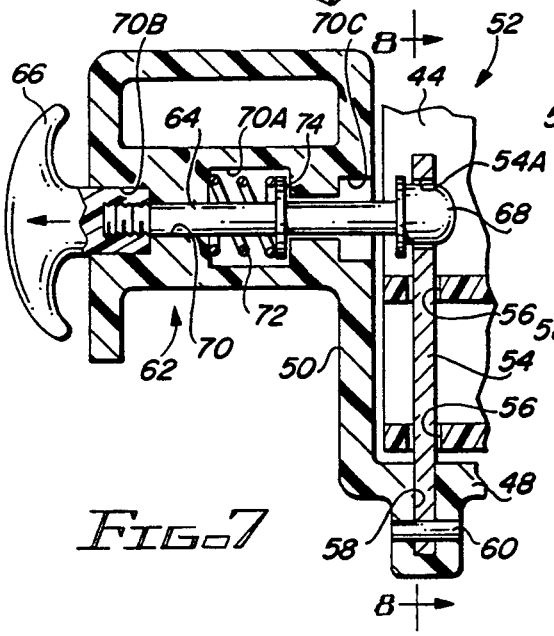
FIG. 7 is an enlarged fragmentary sectional view of a seat back latch assembly employed in the seat apparatus of FIG. 6.
Figure 8:
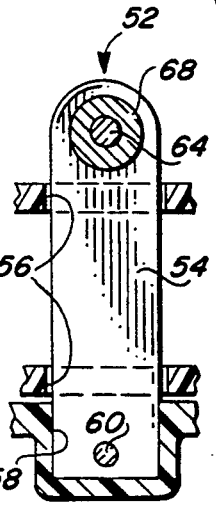
FIG. 8 is another sectional view of the seat back latch assembly taken along line 8—8 of FIG. 7.

Referring to FIGS. 6 to 8, the seat apparatus 10 also includes means 52 for releasably mounting the seat back 18 on and in an upright relation to the seat portion 48 of the interior shell 40 of the base 12. The seat back mounting means 52 basically includes a pair of attachment members 54 in the form of elongated tangs and pairs of vertically-aligned attachment slots 56 formed in portions of the seat back internal shell 44. The attachment members 54 are rigidly and stationarily mounted or secured in any suitable manner on a seat portion 48 of the interior shell 40 of the base 12 in spaced relation to one another and extending upright along a rear edge portion thereof. An example of one suitable way to secure the attachment members 54 on the base 12 is shown in FIGS. 7 and 8 wherein lower portions of the attachment members 54 are retained in recesses 58 in the base 12 by respective lock pins 60. The pairs of attachment slots 56 in the seat back internal shell 44 are spaced apart by the same distance as the attachment members 54 in order to removably receive the attachment members 54 and thereby dispose and maintain the seat back 18 in the desired generally upright position along the rear end of the seat 14.

The seat back mounting means 52 also includes a pair of latch assemblies 62 respectively mounted to rearward ends of the armrest portions 50 of the interior shell 40 of the base 12. The latch assemblies 62 are releasably interengageable with apertures 54A in the upper end portions of the attachment members 54 for releasably attaching the seat back 18 to the base 12. More particularly, each latch assembly 62 includes an elongated shaft 64 having a pull handle 66 screwed on an outer end of the shaft 64 and an enlarged rounded head element 68 screwed on an inner end of the shaft 64. The shaft 64 extends through a passageway 70 defined transversely through each of the armrest portions 50. The passageway 70 has an enlarged middle portion 70A and enlarged opposite end portions 70B, 70C for respectively accommodating a coil spring 72 surrounding the shaft 64 and the handle 66 and head element 68.

In the engaged position of the latch assembly 62 with the attachment member 54 as seen in FIGS. 7 and 8, the head element 68 extends through the aperture 54A in the upper end portion of the attachment member 54 preventing the removal of the seat back 18 from the base 12. An annular disc 74 installed in a fixed relation on the shaft 64 and positioned in the middle portion 70A of the passageway engages the coil spring 72 such that the spring 72 biases the shaft 64 of the latch assembly 62 toward the engaged position of FIG. 7. When the pull handle 66 is pulled in an outward direction (as depicted by the arrow in FIG. 7), the annular disc 74 causes compression of the coil spring 72 and withdrawal of the head element 68 into the inner end portion 70C of the passageway 70 from the aperture 54A in the attachment member 54 and from a hole 75 in a lower side of the back 18 (FIG. 12) and thereby axially shifts of the latch assembly 62 to a disengaged position permitting removal of the seat back 18 from the base 12.

Figure 9:
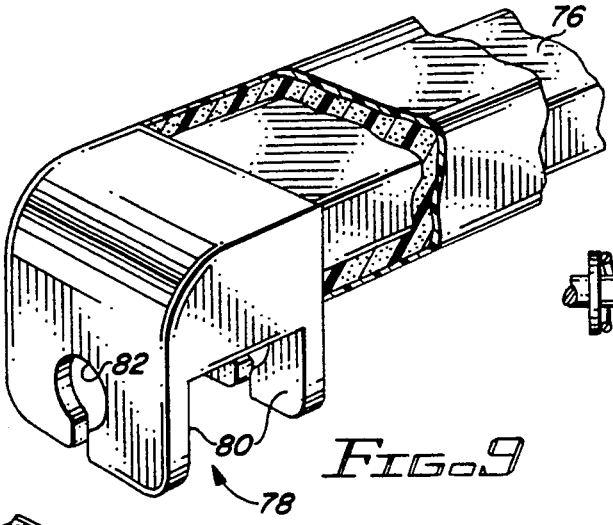
FIG. 9 is an enlarged fragmentary view, with parts broken away and sectioned, of one end of a removable child restraint bar of the seat apparatus of FIG. 1.
Figure 10:
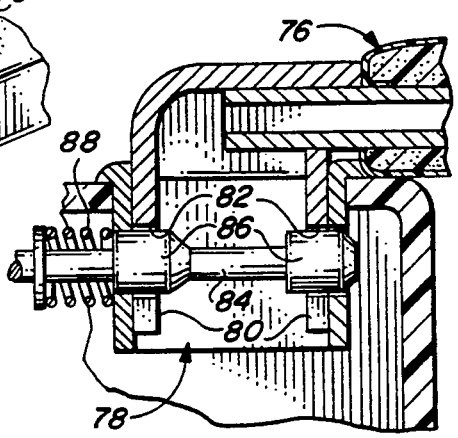
FIG. 10 is an enlarged fragmentary sectional view of a restraint bar lock assembly and one end of the restraint bar taken along line 10—10 of FIG. 1.

Referring to FIGS. 1, 9 and 10, the seat apparatus 10 also includes a removable child restraint bar 76 and a pair of lock assemblies 78 for releasably securing the restraint bar 76 on the armrests 16. The restraint bar 76 is releasably mounted at opposite ends thereof to forward ends of the armrest portions 50 of the interior shell 40 of the base 12 by the lock assemblies 78 such that the restraint bar 76 extends over and is spaced above the seat portion 48 of the interior shell 40 of the base 12 as shown in FIG. 1. Each lock assembly 78 includes a pair of spaced downwardly extending flanges 80 on each opposite end of the restraint bar 76 with keyhole slots 82 defined therein and an elongated shaft 84 with enlarged heads 86 spaced axially thereon for insertion into and withdrawal from the keyhole slots 82 for respectively retaining and releasing the restraint bar 76 at the flanges 80 upon axial movement of the shaft 84.

In the engaged position of the lock assembly 78 as seen in FIG. 10, the enlarged heads 86 extend through the keyhole slots 82 in the flanges 80 preventing the removal of the restraint bar 76 from the armrests 16. When the shaft 86 is pushed inward in the direction of the arrow in FIGS. 10 and 11 against the outward bias of a coil spring 88 surrounding the shaft 86, the enlarged heads 86 are withdrawn from the keyhole slots 82. The diameter of the main portion of the shaft 86 is smaller than the lower ends of the keyhole slots 82 permitting lifting of the restraint bar 76 off the shaft 86.

Figure 12:
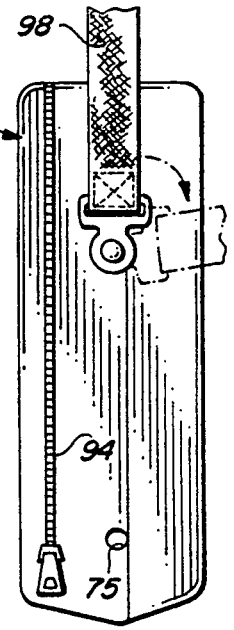
FIG. 12 is a side elevational view of the seat back of the seat apparatus converted to a carrying bag.
Figure 13:
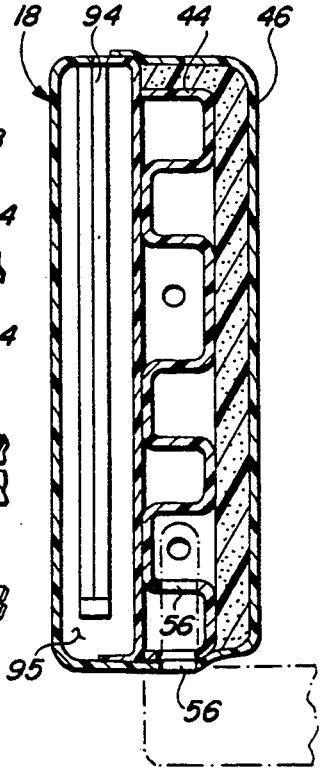
FIG. 13 is a vertical sectional view of the seat back of FIG. 12.
Figure 11:
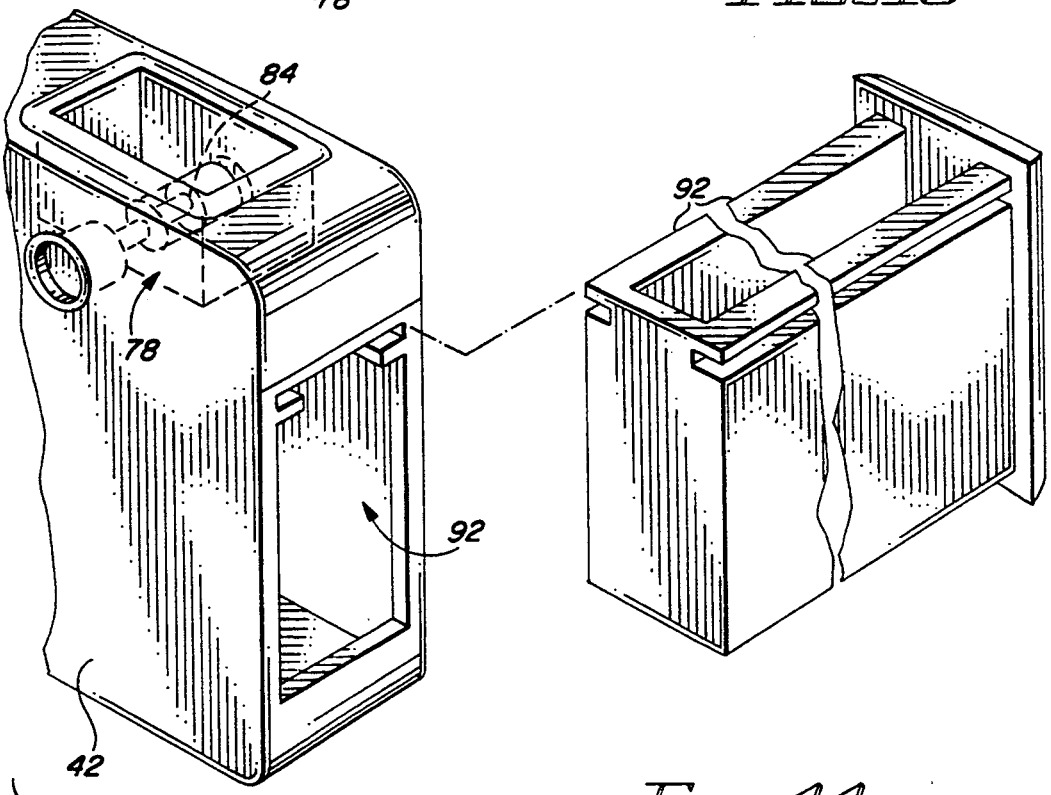
FIG. 11 is an enlarged fragmentary exploded perspective view of the seat apparatus illustrating one storage drawer pulled out from a cavity in one of the armrests of the apparatus.

Referring to FIGS. 11 to 13, the armrests 16 of the seat apparatus 10 each has a cavity 90 and a storage drawer 92 being slidably mounted to the armrest 16 and extending into the cavity 90. Also, the seat back 18 when removed from the base 12 converts to a carrying bag as seen in FIGS. 12 and 13 having a zipper 94 used to open and close an internal storage compartment 95 formed at the rear of the interior framework 44 by the external covering 46. The seat apparatus 10 also includes a conventional seat belt 96 and another belt 98 which can function as a child restraint belt when extended across the chest and under the arms with the seat back 18 is mounted to the base 12 or as a shoulder carrying belt when the seat back 18 is released and removed from the base 12 and used as a carrying bag.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A convertible multi-functional seat apparatus, comprising:

(a) a base having a generally horizontal seat and a pair of generally vertical armrests disposed along and extending above opposite sides of said seat, said seat having means defining an opening formed therein;

(b) a seat back attached to said seat of said base and being disposed in a generally upright position along a rear end of said seat of said base;

(c) a seat potty cover supported on said seat for movement between a first position adjacent to said seat in which said cover overlies and conceals said opening and a second position remote from said seat in which said cover is displaced from and exposes said opening; and (d) a potty assembly disposed in said opening and supported by opening defining means of said seat, said potty assembly including a flexible receptacle and a retainer member supporting said receptacle about a peripheral edge portion thereof and being supported in said opening by said opening defining means of said seat;

(e) said flexible receptacle of said potty assembly being a flexible liner bag fabricated of a material impervious to fluids and having an upper peripheral edge portion defining an open top on said bag;

(f) said retainer member of said potty assembly being an annular ring incorporating means for adjusting the circumferential size of said annular ring to removably fit within said opening in said seat, said upper peripheral edge portion of said plastic liner bag being foldable over said annular ring such that said bag edge portion surrounds said annular ring and is anchored between said annular ring and said opening defining means of said seat wherein said means for adjusting the circumferential size of said annular ring includes a pair of end portions of said annular ring being telescopically inter-fitted together.

2. The seat apparatus of claim 1 wherein said seat also has a rigid receptacle attached to and supported by said opening defining means and underlying and supporting said flexible receptacle.

3. The seat apparatus of claim 1 further comprising:

a urine deflector removably mountable to said seat adjacent to a front side of said opening in said seat.

4. The seat apparatus of claim 1 wherein said base has a rigid interior shell and an exterior covering.

5. The seat apparatus of claim 4 wherein said seat back has a rigid internal shell and an external covering.

6. The seat apparatus of claim 5 further comprising:

a pair of attachment members mounted on a seat portion of said interior shell of said base in spaced relation to one another and extending upright along a rear edge portion thereof; and means defining pairs of vertically-aligned attachment slots in said internal shell of said seat back removably receiving said attachment members on said interior shell of said base so as to dispose said internal shell of said seat back in said generally upright position along said rear end of said seat of said base.

7. The seat apparatus of claim 6 further comprising:

a pair of latch assemblies respectively mounted to rearward ends of a pair of armrest portions of said interior shell of said base, said latch assemblies being releasably engageable with said attachment members for releasably attaching said seat back to said base.

8. The seat apparatus of claim 4 further comprising:

a removable child restraint bar releasably mounted at opposite ends thereof to a pair of armrest portions of said interior shell of said base.

9. The seat apparatus of claim 8 further comprising:

a pair of lock assemblies respectively mounted to forward ends of said armrest portions of said interior shell of said base, said lock assemblies being releasably engageable with said opposite ends of said restraint bar for releasably locking said restraint bar to said armrest portions of said interior shell of said base and extending over and spaced above a seat portion of said interior shell of said base.

10. A convertible multi-functional seat apparatus, comprising:

(a) a base having generally horizontal seat and a pair of generally vertical armrests disposed along and extending above opposite sides of said seat, said seat having means defining an opening formed therein, each of said armrests having a cavity and a storage drawer being slidably mounted to said armrest and extending into said cavity;

(b) a seat back attached to said seat of said base and being disposed in a generally upright position along a rear end of said seat of said base;

(c) a seat potty cover supported on said seat for movement between a first position adjacent to said seat in which said cover overlies and conceals said opening and a second position remote from said seat in which said cover is displaced from and exposes said opening; and (d) a potty assembly disposed in said opening and supported by opening defining means of said seat, said potty assembly including a flexible receptacle and a retainer member supporting said receptacle about a peripheral edge portion thereof and being supported in said opening by said opening defining means of said seat.

11. A convertible multi-functional seat apparatus, comprising:

(a) a base including a rigid interior shell and an exterior covering, said interior shell having a seat portion and a pair of armrest portions disposed along and extending above opposite sides of said seat portion, said seat portion including means defining an opening therein;

(b) a seat back including a rigid internal shell and an external covering, said seat back being disposed along a rear end of said seat portion of said rigid interior shell of said base;

(c) a seat potty cover supported on said seat portion for movement between a first position adjacent to said seat portion in which said cover overlies and conceals said opening and a second position remote from said seat portion in which said cover is displaced from and exposes said opening;

(d) a potty assembly disposed in said opening and supported by said opening defining means of said seat portion, said potty assembly including (i) a flexible receptacle being a flexible liner bag fabricated of a material impervious to fluids and having an upper peripheral edge portion defining an open top on said bag, and (ii) a retainer member being an annular ring incorporating means for adjusting the circumferential size of said annular ring to removably fit within said opening in said seat, said upper peripheral edge portion of said plastic liner bag being foldable over said annular ring such that said bag edge portion surrounds said annular ring and is anchored between said annular ring and said opening defining means of said seat wherein said means for adjusting the circumferential size of said annular ring includes a pair of end portions of said annular ring being telescopically inter-fitted together; and (e) means for releasably mounting said seat back on and in an upright relation to said seat portion of said base.

12. The seat apparatus of claim 11 wherein said seat back mounting means includes:

a pair of attachment members mounted on said seat portion of said interior shell of said base in spaced relation to one another and extending upright along a rear edge portion thereof; and means defining pairs of vertically-aligned attachment slots in said internal shell of said seat back removably receiving said attachment members on said internal shell of said seat portion of said base so as to dispose said internal shell of said seat back in said generally upright position along said rear end of said seat portion of said internal shell of said base.

13. The seat apparatus of claim 12 wherein said seat back mounting means also includes a pair of latch assemblies respectively mounted to rearward ends of said armrest portions of said interior shell of said base, said latch assemblies being releasably engageable with said attachment members for releasably attaching said seat back to said seat portion of said base.

14. The seat apparatus of claim 11 further comprising:

a removable child restraint bar releasably mounted at opposite ends thereof to said armrest portions of said interior shell of said base.

15. The seat apparatus of claim 14 further comprising:

a pair of lock assemblies respectively mounted to forward ends of said armrest portions of said interior shell of said base, said lock assemblies being releasably engageable with said opposite ends of said restraint bar for releasably locking said restraint bar to said armrest portions of said interior shell of said base and extending over and spaced above said seat portion of said interior shell of said base.

16. A convertible multi-functional seat apparatus, comprising:

(a) a base including a rigid interior shell and an exterior covering, said interior shell having a seat portion and a pair of armrest portions disposed along and extending above opposite sides of said seat portion, said seat portion including means defining an opening therein;

(b) a seat back including a rigid internal shell and an external covering, said seat back being disposed along a rear end of said seat portion of said rigid interior shell of said base;

(c) a seat potty cover supported on said seat portion for movement between a first position adjacent to said seat portion in which said cover overlies and conceals said opening and a second position remote from said seat portion in which said cover is displaced from and exposes said opening;

(d) a potty assembly disposed in said opening and supported by said opening defining means of said seat portion, said potty assembly including (i) a flexible receptacle being a flexible liner bag fabricated of a material impervious to fluids and having an upper peripheral edge portion defining an open top on said bag, and (ii) a retainer member being an annular ring incorporating means for adjusting the circumferential size of said annular ring to removably fit within said opening in said seat, said upper peripheral edge portion of said plastic liner bag being foldable over said annular ring such that said bag edge portion surrounds said annular ring and is anchored between said annular ring and said opening defining means of said seat wherein said means for adjusting the circumferential size of said annular ring includes a pair of end portions of said annular ring being telescopically inter-fitted together; and (e) a removable child restraint bar releasably mounted at opposite ends thereof to said armrest portions of said interior shell of said base.

17. The seat apparatus of claim 16 further comprising:

a pair of lock assemblies respectively mounted to forward ends of said armrest portions of said interior shell of said base, said lock assemblies being releasably engageable with said opposite ends of said restraint bar for releasably locking said restraint bar to said armrest portions of said interior shell of said base and extending over and spaced above said seat portion of said interior shell of said base.

* * * * *